US007122732B2

(12) United States Patent
Cho et al.

(10) Patent No.: US 7,122,732 B2
(45) Date of Patent: Oct. 17, 2006

(54) APPARATUS AND METHOD FOR SEPARATING MUSIC AND VOICE USING INDEPENDENT COMPONENT ANALYSIS ALGORITHM FOR TWO-DIMENSIONAL FORWARD NETWORK

(75) Inventors: Nam-Ik Cho, Seoul (KR); Jun-Won Choi, Seoul (KR); Hyung-Il Koo, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 299 days.

(21) Appl. No.: 10/859,469

(22) Filed: Jun. 2, 2004

(65) Prior Publication Data

US 2005/0056140 A1 Mar. 17, 2005

(30) Foreign Application Priority Data

Jun. 2, 2003 (KR) ..... 10-2003-0035304

(51) Int. Cl.
*G10H 7/00* (2006.01)

(52) U.S. Cl. ..... 84/617; 704/233; 434/307 A; 84/477 R

(58) Field of Classification Search ..... 704/231, 704/233; 707/236; 434/307 A
See application file for complete search history.

(56) References Cited

U.S. PATENT DOCUMENTS 3,204,034 A * 8/1965 Ballard et al. ..... 370/208
4,587,620 A * 5/1986 Niimi et al. ..... 702/193
5,210,366 A * 5/1993 Sykes, Jr. ..... 84/616
5,340,317 A * 8/1994 Freeman ..... 434/321
5,353,376 A * 10/1994 Oh et al. ..... 704/233
5,377,302 A * 12/1994 Tsiang ..... 704/235
5,649,234 A * 7/1997 Klappert et al. ..... 715/500.1
5,898,119 A * 4/1999 Tseng et al. ..... 84/610
5,953,380 A * 9/1999 Ikeda ..... 375/346
6,038,535 A * 3/2000 Campbell ..... 704/275
6,081,784 A * 6/2000 Tsutsui ..... 704/501
6,144,937 A * 11/2000 Ali ..... 704/233

(Continued)

FOREIGN PATENT DOCUMENTS

KR 0132888 12/1997

(Continued)

OTHER PUBLICATIONS

English Abstract***.

*Primary Examiner*—Lincoln Donovan
*Assistant Examiner*—Christina Russell
(74) *Attorney, Agent, or Firm*—F. Chau & Associates, LLC

(57) ABSTRACT

Provided is an apparatus and method for separating music and voice using an independent component analysis method for a two-dimensional forward network. The apparatus of separating music and voice can separate voice signal and a music signal, each of which are independently recorded, from a mixed signal, in a short convergence time by using the independent component analysis method, which estimates a signal mixing process according to a difference in record positions of sensors. Thus, users can easily select accompaniment from their own compact discs(CDs), digital video discs(DVDs), or audio cassette tapes, or FM radio, and listen to music of improved quality in real time. Accordingly, the users can just enjoy the music or sing along. Furthermore, since the independent component analysis method in the apparatus of separating music and voice is simple and time taken to perform the method is not long, the method can be easily used in a digital signal processor (DSP) chip, a microprocessor, or the like.

14 Claims, 2 Drawing Sheets

U.S. PATENT DOCUMENTS

| | | | | |
|---|---|---|---|---|
| 6,248,944 | B1 * | 6/2001 | Ito | 84/477 R |
| 6,931,377 | B1 * | 8/2005 | Seya | 704/277 |
| 6,985,858 | B1 * | 1/2006 | Frey et al. | 704/233 |
| 2001/0034601 | A1 * | 10/2001 | Chujo et al. | 704/233 |
| 2002/0038211 | A1 * | 3/2002 | Rajan | 704/233 |
| 2002/0101981 | A1 * | 8/2002 | Sugiyama | 379/406.01 |
| 2003/0097261 | A1 * | 5/2003 | Jeon et al. | 704/233 |
| 2004/0218492 | A1 * | 11/2004 | Sako | 369/47.35 |

FOREIGN PATENT DOCUMENTS

| | | |
|---|---|---|
| KR | 040565 | 8/1998 |

* cited by examiner

APPARATUS AND METHOD FOR SEPARATING MUSIC AND VOICE USING INDEPENDENT COMPONENT ANALYSIS ALGORITHM FOR TWO-DIMENSIONAL FORWARD NETWORK

BACKGROUND OF THE INVENTION

1. Technical Field

The present disclosure relates to a song accompaniment apparatus and method, and more particularly, to a song accompaniment apparatus and method for eliminating voice signals from a mixture of music and voice signals.

2. Description of the Related Art

Song accompaniment apparatuses having karaoke functions are widely used for singing and/or amusement. A song accompaniment apparatus generally outputs (e.g., plays) a song accompaniment to which a person can sing along. Alternatively, the person can simply enjoy the music without singing along. As used herein, the term "song accompaniment" refers to music without voice accompaniment. In such song accompaniment apparatuses, a memory is generally used to store the song accompaniments which a user selects. Therefore, the number of song accompaniments for a given song accompaniment apparatus may be limited by the storage capacity of the memory. Also, such song accompaniment apparatuses are generally expensive.

Karaoke functions can be easily implemented for compact disc (CD) players, digital video disc (DVD) players, and cassette tape players outputting only song accompaniment. Users can play their own CDs, DVDs, and cassette tapes. Similarly, karaoke functions can also be easily implemented if voice is eliminated from FM audio broadcast outputs (e.g., from a radio) such that only a song accompaniment is output. Users can play their favorite radio stations.

Acoustic signals output from CD players, DVD players, cassette tape players, and FM radio generally contain a mixture of music and voice signals. Technology for eliminating the voice signals from the mixture has not been perfected yet. A general method of eliminating voice signals from the mixture includes transforming the acoustic signals into frequency domains and removing specific bands in which the voice signals are present. The transformation to frequency domains is generally achieved by using a fast Fourier transform (FFT) or subband filtering. A method of removing voice signals from a mixture using such frequency conversion is disclosed in U.S. Pat. No. 5,375,188, filed on Dec. 20, 1994.

However, since some music signal components are included in the same frequency bands as voice signals, in the range of several kHz, some music signals are lost when those frequency bands are removed, thereby decreasing the quality of the output accompaniment. To reduce the loss of music signals from the mixture, an attempt has been made to detect a pitch frequency of the voice signals and remove only a frequency domain of the pitch. However, since it is difficult to detect the pitch of the voice signals due to the influence of the music signals, this approach is not very reliable.

SUMMARY OF THE INVENTION

The present invention provides an apparatus for separating voice signals and music signals from a mixture of voice and music signals during a short convergence time by using an independent component analysis method for a two-dimensional forward network. The apparatus estimates a signal mixing process according to a difference in recording positions of sensors.

The present invention provides a method of separating voice signals and music signals from a mixture of voice and music signals during a short convergence time by using an independent component analysis algorithm for a two-dimensional forward network. The method estimates a signal mixing process according to a difference in recording positions of sensors.

According to an aspect of the present invention, there is provided an apparatus for separating music and voice from a mixture comprising an independent component analyzer, a music signal selector, a filter, and a multiplexer.

The independent component analyzer receives a first filtered signal and a second filtered signal comprising of music and voice components, and outputs a current first coefficient, a current second coefficient, a current third coefficient, and a current fourth coefficient, which are determined using an independent component analysis method.

The music signal selector outputs a multiplexer control signal in response to a most significant bit of the second coefficient and a most significant bit of the third coefficient.

The filter which receives an R channel signal and an L channel signal representing audible signals, and outputs a first filtered signal and a second filtered signal.

The multiplexer selectively outputs the first filtered signal or the second filtered signal in response to a logic state of the multiplexer control signal.

The filter may further include a first multiplier which multiplies the R channel signal by the first coefficient and outputs a first product signal; a second multiplier which multiplies the R channel signal by the second coefficient and outputs a first product signal; a third multiplier which multiplies the L channel signal by the third coefficient and outputs a third product signal; a fourth multiplier which multiplies the L channel signal by the fourth coefficient and outputs a fourth product signal; a first adder which adds the first product signal and the third product signal to determine the first filtered signal; and a second adder which adds the second product signal and the fourth product signal to determine the second filtered signal.

The independent component analyzer may calculate the current first coefficient, the current second coefficient, the current third coefficient, and the current fourth coefficient from the following equation,:

$$W_n = W_{n-1} + (I - 2\tan h(u)u^T)W_{n-1},$$

wherein $W_n$ is a 2×2 matrix composed of the current first coefficient, the current second coefficient, the current third coefficient, and the current fourth coefficient, $W_{n-1}$ is a 2×2 matrix composed of a previous first coefficient, a previous second coefficient, a previous third coefficient, and a previous fourth coefficient, I is a 2×2 unit matrix, u is a 2×1 column matrix composed of the first filtered signal and the second filtered signal, and $u^T$ is a row matrix, wherein $u^T$ is the transpose of the column matrix u.

The current first coefficient, the current second coefficient, the current third coefficient, and the current fourth coefficient are respectively $W_n$11, $W_n$21, $W_n$12, and $W_n$22, the previous first coefficient, the previous second coefficient, the previous third coefficient, and the previous fourth coefficient are respectively $W_{n-1}$11, $W_{n-1}$21, $W_{n-1}$12, and $W_{n-1}$22, and the first filtered signal and the second filtered signal are respectively u1 and u2.

The R channel signal and the L channel signal may be exchangeable without distinction.

The R channel signal and the L channel signal may be 2-channel stereo digital signals output from an audio system including a CD player, a DVD player, an audio cassette tape player, or an FM audio broadcasting receiver.

According to another aspect of the present invention, there is provided a method of separating music and voice, comprising: (a) receiving at an independent component analyzer a first filtered signal and a second filtered signal comprising of music and voice components and outputting a current first coefficient, a current second coefficient, a current third coefficient, and a current fourth coefficient; (b) generating a multiplexer control signal in response to a most significant bit of the second coefficient and a most significant bit of the third coefficient; (c) receiving an R channel signal and an L channel signal representing audible signals, and outputting the first filtered signal and the second filtered signal; and (d) selectively outputting the first filtered signal or the second filtered signal in response to a logic state of the multiplexer control signal.

The step (c) may further include: (i) generating a first product signal by multiplying the R channel signal by the current first coefficient; (ii) generating a second product signal by multiplying the R channel signal by the current second coefficient; (iii) generating a third product signal by multiplying the L channel signal by the current third coefficient; (iv) generating a fourth product signal by multiplying the L channel signal by the current fourth coefficient; (v) generating the first filtered signal by adding the first product signal and the third product signal; and (vi) generating the second filtered signal by adding the second product signal and the fourth product signal.

The independent component analyzer may calculate the current first coefficient, the current second coefficient, the current third coefficient, and the current fourth coefficient from the following equation:

$$W_n = W_{n-1} + (I - 2\tan h(u)u^T)W_{n-1},$$

wherein $W_n$ is a 2×2 matrix composed of the current first coefficient, the current second coefficient, the current third coefficient, and the current fourth coefficient, $W_{n-1}$ is a 2×2 matrix composed of a previous first coefficient, a previous second coefficient, a previous third coefficient, and a previous fourth coefficient, I is a 2×2 unit matrix, u is a 2×1 column matrix composed of the first filtered signal and the second filtered signal, and $u^T$ is a row matrix, wherein $u^T$ is the transpose of the column matrix u.

The current first coefficient, the current second coefficient, the current third coefficient, and the current fourth coefficient are respectively $W_n$11, $W_n$21, $W_n$12, and $W_n$22, the previous first coefficient, the previous second coefficient, the previous third coefficient, and the previous fourth coefficient are respectively $W_{n-1}$11, $W_{n-1}$21, $W_{n-1}$12, and $W_{n-1}$22, and the first filtered signal and the second filtered signal are respectively u1 and u2.

The R channel signal and the L channel signal may be exchangeable without distinction.

The R channel signal and the L channel signal may be 2-channel stereo digital signals output from an audio system including a CD player, a DVD player, an audio cassette tape player, or an FM audio broadcasting receiver.

BRIEF DESCRIPTION OF THE DRAWINGS

Preferred embodiments of the invention can be understood in more detail from the following descriptions taken in conjunction with the accompanying drawings in which.

DETAILED DESCRIPTION OF THE INVENTION

Preferred embodiments of the present invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art.

Figure 1:
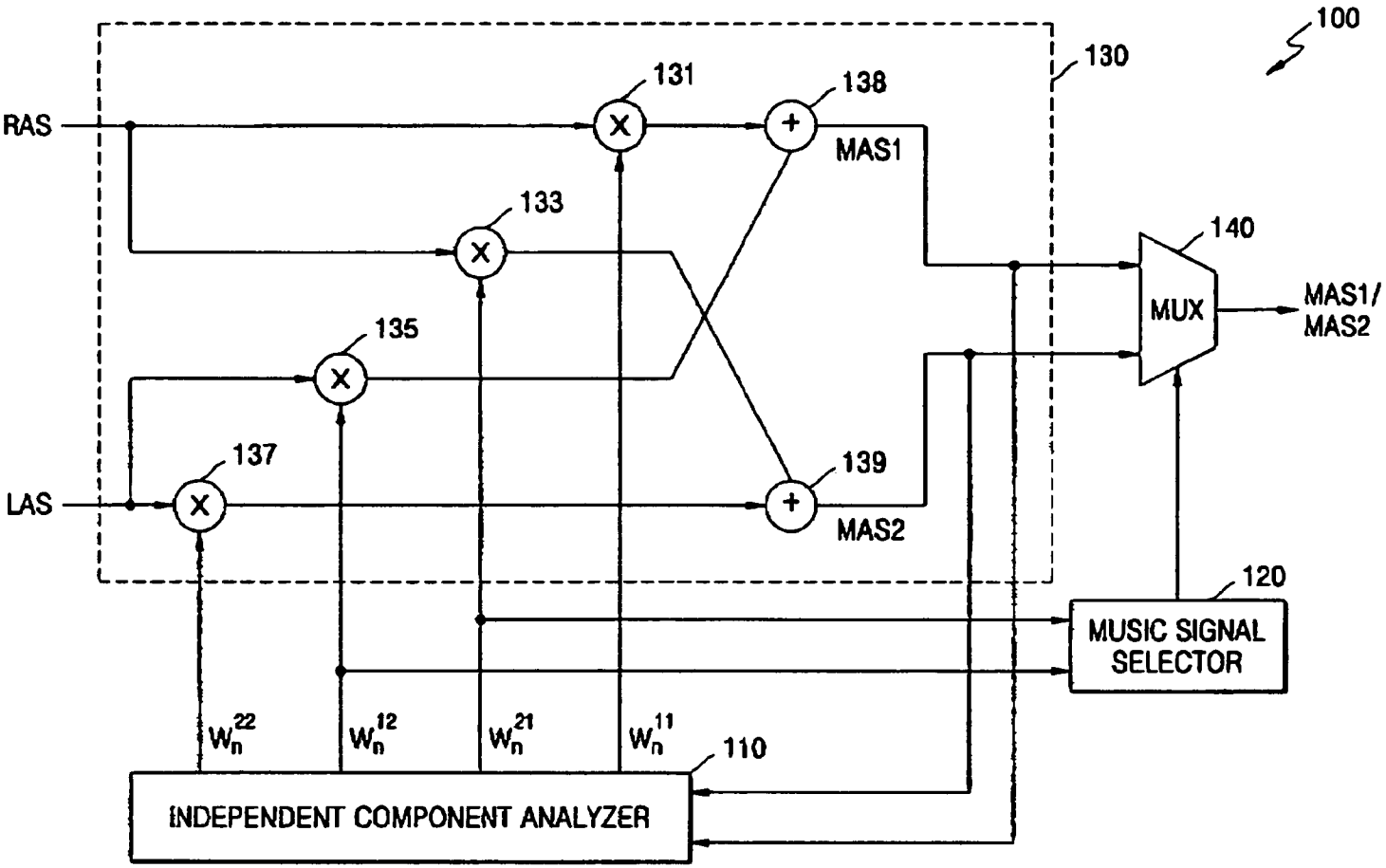
FIG. 1 is a block diagram of an apparatus for separating music and voice, in accordance with a preferred embodiment of the present invention.

Referring to FIG. 1, a block diagram is shown of an apparatus 100 for separating music and voice, in accordance with one preferred embodiment of the present invention. The apparatus 100 includes an independent component analyzer 110, a music signal selector 120, a filter 130, and a multiplexer 140.

The independent component analyzer 110 receives a first output signal MAS1 and a second output signal MAS2, each of which are composed of a music signal and a voice signal. The independent component analyzer 110 outputs a current coefficient $W_n$11, a current second coefficient $W_n$21, a current third coefficient $W_n$12, and a current fourth coefficient $W_n$22. The current coefficients are calculated using an independent component analysis method. The subscript n represents a current iteration of the independent component analysis method.

As explained in greater detail below, the independent component method separates a mixed acoustic signal into a separate voice signal and music signal. The independence between the voice signal and music signal is maximized. That is, the voice signal and music signal are restored to their original state prior to being mixed. The mixed acoustic signal may be obtained, for example, from one or more sensors.

The music signal selector 120 outputs a multiplexer control signal, which has a first logic state (e.g., a low logic state) and a second logic state (e.g., a high logic state). The first logic state is output in response to a second logic state of the most significant bit of the second coefficient $W_n$21. The second logic state is output in response to a second logic state of the most significant bit of the third coefficient $W_n$12. The most significant bits of the second coefficient $W_n$21 and the third coefficient $W_n$12 have signs representing negative values or positive values. When the most significant bits are in a second logic state, the second coefficient $W_n$21 and the third coefficient $W_n$12 have negative values. Here, when the second coefficient $W_n$21 is negative value, the second output signal MAS2 is an estimated music signal. Also, when the third coefficient $W_n$21 is negative value, the first output signal MAS1 is an estimated music signal.

The filter 130 receives an R channel signal RAS and an L channel signal LAS, each of which represent audible signals. A first multiplier 131 multiplies the R channel signal RAS by the current first coefficient $W_n$11 and outputs a first multiplication result. A third multiplier 135 multiplies the L channel signal LAS by the current third coefficient $W_n$12 and outputs a third multiplication result. The first multiplication result and the third multiplication result are added by a first adder 138 to produce the first output signal MAS1.

A second multiplier 133 multiplies the R channel signal RAS by the current second coefficient $W_n$21 and outputs a second multiplication result. A fourth multiplier 137 multiplies the L channel signal LAS by the current fourth coefficient $W_n$22 and outputs a fourth multiplication result. The second multiplication result and the fourth multiplication result are added by a second adder 139 to produce the second output signal MAS2.

The R channel signal RAS and the L channel signal LAS may be 2-channel digital signals output from an audio system such as a compact disc (CD) player, a digital video disc (DVD) player, an audio cassette tape player, or an FM receiver. The same output may result if the values of the R channel signal RAS and the L channel signal LAS are exchanged. That is, the R channel signal RAS and the L channel signal LAS may be exchangeable without consequence.

The multiplexer 140 outputs the first output signal MAS1 or the second output signal MAS2 in response to a logic state of the multiplexer control signal. For example, when the second coefficient $W_n$21 is negative value, the multiplexer control signal has the first logic state and the multiplexer 140 outputs the second output signal MAS2. Also, when the third coefficient $W_n$12 is negative value, the multiplexer control signal has the second logic state and the multiplexer 140 outputs the first output signal MAS1. Since the first output signal MAS1 or the second output signal MAS2 output from the multiplexer 140 is an estimated music signal without a voice signal (i.e., a song accompaniment), a user can listen to the song accompaniment through a speaker, for example.

Figure 2:
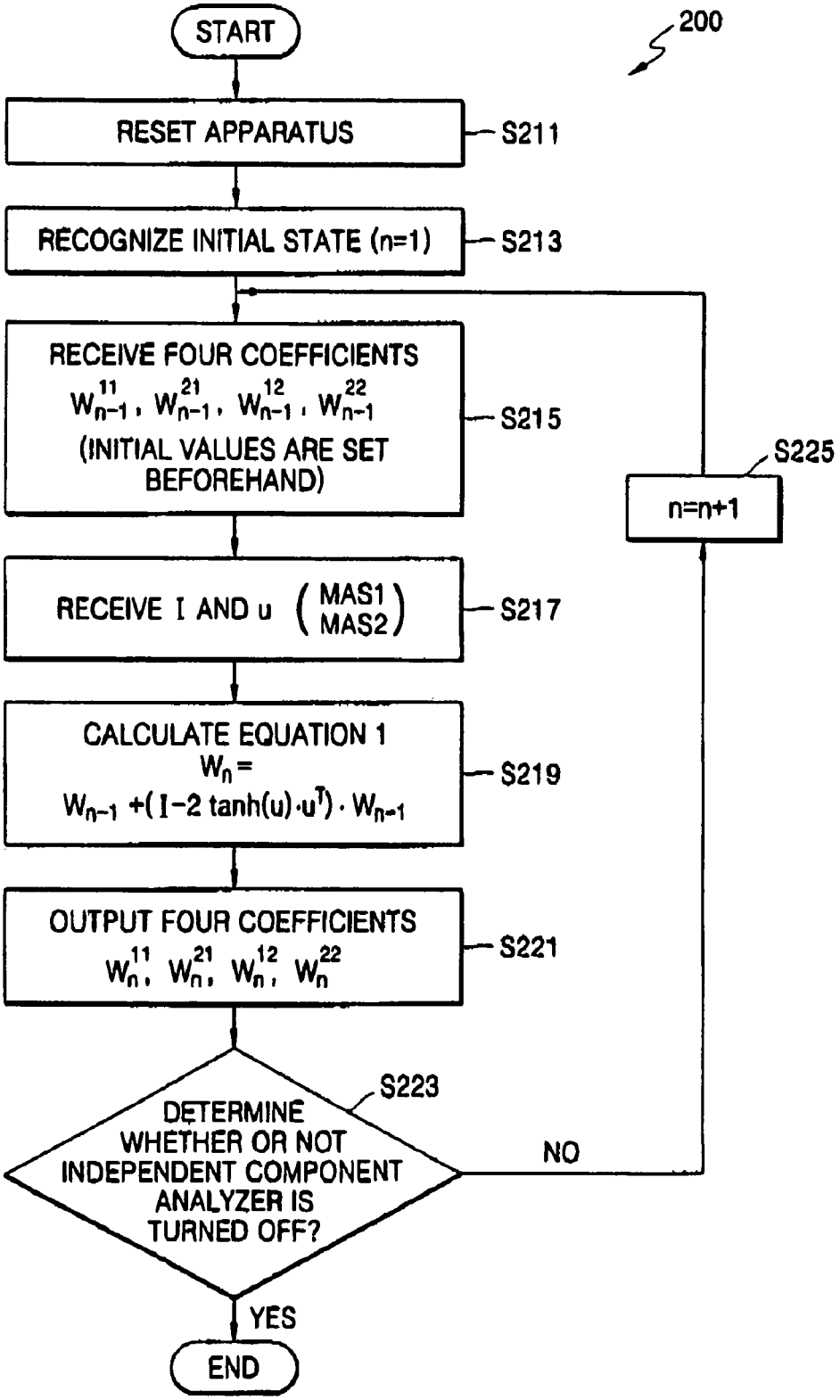
FIG. 2 is a flow diagram of an independent component analysis method, in accordance with a preferred embodiment of the present invention.

Referring to FIG. 2, a flow diagram of the independent component analysis method 200 is shown, in accordance with a preferred embodiment of the present invention. The flow diagram illustrates an independent component analysis method 200 for a two-dimensional forward network as shown in FIG. 1. The independent component analysis method 200 may be performed by the independent component analyzer 110 of FIG. 1.

The independent component analysis method 200 of FIG. 2 controls the current first coefficient $W_n$11, the current second coefficient $W_n$21, the current third coefficient $W_n$12, and the current fourth coefficient $W_n$22 of FIG. 1. The independent component analysis method is implemented as a non-linear function (tan h(u)) of a matrix u composed of the output signals MAS1 and MAS2 of FIG. 1, as shown in equation (1) below. As previously mentioned, the output signals MAS1 and MAS2 are composed of a music signal and a voice signal.

$$W_n = W_{n-1} + (I - 2\tan h(u)u^T)W_{n-1}, \tag{1}$$

$W_n$21, is a 2×2 matrix composed of the current four coefficients (i.e., $W_n$11, $W_n$21, $W_n$12, and $W_n$22), $W_{-1}$ is a 2×2 matrix composed of previous four coefficients (i.e., $W_{n-1}$11, $W_{n-1}$21, $W_{n-1}$12, and $W_{n-1}$22), I is a 2×2 unit matrix, u 2×1 column matrix composed of the output signals, and $u^T$ is a row matrix, which is the transpose of the column matrix u.

In equation (1), when $W_n$ is represented as a 2×2 matrix having the current four coefficients $W_n$11, $W_n$21, $W_n$12, and $W_n$22, expression (2) below is established. Similarly, in equation (1), when $W_{n-1}$ is represented as a 2×2 matrix having the previous four coefficients $W_{n-1}$11, $W_{n-11}$21, $W_{n-1}$12, and $W_{n-1}$22, expression (3) below is established. Since I is a 2×2 unit matrix, expression (4) below is established. Since u is a 2×1 column matrix composed of the two output signals MAS1 and MAS2, equation (5) below is established. Since UT is a row matrix, which is the transpose of the column matrix u, equation (6) below is established. According to expression (2) and equation (5), the current first coefficient $W_n$11, the current second coefficient $W_n$21, the current third coefficient $W_n$12, and the current fourth coefficient $W_n$22 are elements constituting the matrix $W_n$. The first output signal MAS1 and the second output signal MAS2 are respectively u1 and u2 constituting the matrix u.

$$\begin{bmatrix} W_n11 & W_n12 \\ W_n21 & W_n22 \end{bmatrix} \tag{2}$$

$$\begin{bmatrix} W_{n-1}11 & W_{n-1}12 \\ W_{n-1}21 & W_{n-1}22 \end{bmatrix} \tag{3}$$

$$\begin{bmatrix} 1 & 0 \\ 0 & 1 \end{bmatrix} \tag{4}$$

$$\begin{bmatrix} u1 \\ u2 \end{bmatrix} = \begin{bmatrix} MAS1 \\ MAS2 \end{bmatrix} \tag{5}$$

$$[u1 \quad u2] = [MAS1 \quad MAS2] \tag{6}$$

The independent component analyzer 110 of FIG. 1 resets the apparatus 100 for separating music and voice in step S211 when the apparatus is turned on, recognizes an initial state upon reset, for example, when n=1, in step S213, and receives four coefficients $W_0$11, $W_0$21, $W_0$12, and $W_0$22, which are set beforehand as initial values, in step S215. Further, the independent component analyzer 110 receives I and u of equation (1) in step S217.

Next, the independent component analyzer 110 of FIG. 1 calculates equation (1) above in step S219, and outputs the current four coefficients $W_n$11, $W_n$21, $W_n$12, and $W_n$22 in step S221. Whether the independent component analyzer 110 is turned off is determined in step S223. If it is determined in step S223 that the independent component analyzer 110 is not turned off, the independent component analyzer 110 increments n by 1 in step S225, and then performs again steps S215 to S221.

The independent component analysis method 200 of FIG. 2 is performed in a short convergence time. Therefore, when the apparatus 100 of FIG. 1 for separating music and voice is mounted on an audio system and a pure music signal (i.e., without a voice signal) estimated through the independent component analysis method 200 is output through a speaker, a user can listen to the pure music signal of improved quality in real time.

As described above, the apparatus 100 of FIG. 1 for separating music and voice according to a preferred embodiment of the present invention includes the independent component analyzer 110 which receives the output signals MAS1 and MAS2 composed of a music signal and a voice signal and outputs the current first coefficient $W_n$11, the current second coefficient $W_n$21, the current third coefficient $W_n$12, and the current fourth coefficient $W_n$22 calculated using the independent component analysis method, such that input acoustic signals RAS and LAS are processed according to the current first, second, third, and fourth coefficients (i.e., $W_n$11, $W_n$21, $W_n$12, and $W_n$22, respectively). As a result, a music signal and a voice signal are estimated from a mixed signal, and a pure music signal can be determined.

The apparatus 100 of FIG. 1 for separating music and voice according to a preferred embodiment of the present invention can separate a voice signal and a music signal from a mixed signal in a short convergence time by using the independent component analysis method. The music signal and the voice signal of the mixed signal may each be independently recorded. The independent component analysis method 200 of FIG. 2 estimates a signal mixing process according to a difference in recording positions of sensors. Thus, users can easily select accompaniment from their own CDs, DVDs, or audio cassette tapes, or FM radio, and listen to music of improved quality in real time. The users can listen to the song accompaniment alone or sing along (i.e., add their own lyrics). Furthermore, since the independent component analysis method 200 for separating music and voice is relatively simple and time taken to perform the independent component analysis method 200 is generally not long, the method can be easily implemented in a digital signal processor (DSP) chip, a microprocessor, or the like.

Although the illustrative embodiments have been described herein with reference to the accompanying drawings, it is to be understood that the present invention Is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. An apparatus for separating music and voice from a mixture, comprising:

an independent component analyzer which receives a first filtered signal and a second filtered signal comprising of music and voice components, and outputs a current first coefficient, a current second coefficient, a current third coefficient, and a current fourth coefficient;

a music signal selector which outputs a multiplexer control signal in response to a most significant bit of the second coefficient and a most significant bit of the third coefficient;

a filter which receives an R channel signal and an L channel signal representing audible signals, and outputs a first filtered signal and a second filtered signal; and a multiplexer which selectively outputs the first filtered signal or the second filtered signal in response to the multiplexer control signal.

2. The apparatus of claim 1, wherein the filter further comprises:

a first multiplier which multiplies the R channel signal by the first coefficient and outputs a second product signal;

a second multiplier which multiplies the R channel signal by the second coefficient and outputs a first product signal;

a third multiplier which multiplies the L channel signal by the third coefficient and outputs a third product signal;

a fourth multiplier which multiplies the L channel signal by the fourth coefficient and outputs a fourth product signal;

a first adder which adds the first product signal and the third product signal to determine the first filtered signal; and a second adder which adds the second product signal and the fourth product signal to determine the second filtered signal.

3. The apparatus of claim 1, wherein the independent component analyzer determines the current first coefficient, the current second coefficient, the current third coefficient, and the current fourth coefficient from the following equation:

$$W_n = W_{n-1} + (I - 2\tan h(u)u^T)W_{n-1},$$

wherein $W_n$ is a 2×2 matrix composed of the current first coefficient, the current second coefficient, the current third coefficient, and the current fourth coefficient, $W_{n-1}$ is a 2×2 matrix composed of a previous first coefficient, a previous second coefficient, a previous third coefficient, and a previous fourth coefficient, I is a 2×2 unit matrix, u is a 2×1 column matrix composed of the first filtered signal and the second filtered signal, and $u^T$ is a row matrix, wherein $u^T$ is a transpose of the column matrix u.

4. The apparatus of claim 3, wherein the current first coefficient, the current second coefficient, the current third coefficient, and the current fourth coefficient are respectively $W_n$11, $W_n$21, $W_n$12, and $W_n$22, the previous first coefficient, the previous second coefficient, the previous third coefficient, and the previous fourth coefficient are respectively $W_{n-1}$11, $W_{n-1}$21, $W_{n-1}$12, and $W_{n-1}$22, and the first filtered signal and the second filtered signal are respectively u1 and u2.

5. The apparatus of claim 1, wherein the R channel signal and the L channel signal are exchangeable without distinction.

6. The apparatus of claim 1, wherein the R channel signal and L channel signal are 2-channel stereo digital signals output from an audio system.

7. The apparatus of claim 6, wherein the audio system is one of a compact disc player, a digital video-disc player, an audio cassette tape player, and an FM receiver.

8. A method of separating music and voice from a mixture, comprising:

(a) receiving at an independent component analyzer a first filtered signal and a second filtered signal comprising of music and voice components and outputting a current first coefficient, a current second coefficient, a current third coefficient, and a current fourth coefficient;

(b) generating a multiplexer control signal in response to a most significant bit of the second coefficient and a most significant bit of the third coefficient;

(c) receiving an R channel signal and an L channel signal representing audible signals, and outputting the first filtered signal and the second filtered signal; and (d) selectively outputting the first filtered signal or the second filtered signal in response to a logic state of the multiplexer control signal.

9. The method of claim 8, wherein the step (c), further comprises:

(i) generating a first product signal by multiplying the R channel signal by the current first coefficient;

(ii) generating a second product signal by multiplying the R channel signal by the current second coefficient;

(iii) generating a third product signal by multiplying the L channel signal by the current third coefficient;

(iv) generating a fourth product signal by multiplying the L channel signal by the current fourth coefficient;

(v) generating the first filtered signal by adding the first product signal and the third product signal; and (vi) generating the second filtered signal by adding the second product signal and the fourth product signal.

10. The method of claim 8, wherein the independent component analyzer determines the current first coefficient, the current second coefficient, the current third coefficient, and the current fourth coefficient from the following equation:

$$W_n = W_{n-1} + (I - 2\tan h(u)u^T)W_{n-1},$$

wherein $W_n$ is a 2×2 matrix composed of the current first coefficient, the current second coefficient, the current third coefficient, and the current fourth coefficient, $W_{n-1}$ is a 2×2 matrix composed of a previous first coefficient, a previous second coefficient, a previous third coefficient, and a previous fourth coefficient, I is a 2×2 unit matrix, u is a 2×1 column matrix composed of the first filtered signal and the second filtered signal, and $u^T$ is a row matrix, wherein $u^T$ is the transpose of the column matrix u.

11. The method of claim 10, wherein the current first coefficient, the current second coefficient, the current third coefficient, and the current fourth coefficient are respectively $W_n$11, $W_n$21, $W_n$12, and $W_n$22, the previous first coefficient, the previous second coefficient, the previous third coefficient, and the previous fourth coefficient are respectively $W_{n-1}$11, $W_{n-1}$21, $W_{n-1}$12, and $W_{n-1}$22, and the first filtered signal and the second filtered signal are respectively u1 and u2.

12. The method of claim 8, wherein the R channel signal and the L channel signal are exchangeable without distinction.

13. The method of claim 8, wherein the R channel signal and the L channel signal are 2-channel stereo digital signals output from an audio system.

14. The method of claim 13, wherein the audio system is one of a compact disc player, a digital video disc player, an audio cassette tape player, and an FM receiver.

* * * * *